US010487567B1

(12) United States Patent
Blair

(10) Patent No.: US 10,487,567 B1
(45) Date of Patent: Nov. 26, 2019

(54) APPARATUS AND METHOD FOR INSTALLING GLASS

(76) Inventor: Almon Blair, Alma, AR (US)

( * ) Notice: Subject to any disclaimer, the term of this patent is extended or adjusted under 35 U.S.C. 154(b) by 2149 days.

(21) Appl. No.: 12/803,081

(22) Filed: Jun. 18, 2010

Related U.S. Application Data

(63) Continuation of application No. 11/824,584, filed on Jun. 28, 2007, now abandoned.

(51) Int. Cl.
*E06B 3/32* (2006.01)
*E06B 3/46* (2006.01)

(52) U.S. Cl.
CPC ..... *E06B 3/4618* (2013.01)

(58) Field of Classification Search
CPC ..... E06B 3/4618; E06B 3/4627
USPC ..... 52/207, 204.593, 6, 656.5, 204.1, 204.5, 52/204.51, 203, 211; 49/413, 380, 209, 49/130, 164, 168; 160/184, 194, 200, 160/201, 113, 117, 118
See application file for complete search history.

(56) References Cited

U.S. PATENT DOCUMENTS 2,373,023 A * 4/1945 Goodwin ..... 49/102
2,895,183 A * 7/1959 Dumbolton ..... 160/197
3,141,533 A * 7/1964 Below et al. ..... 52/126.7
3,260,303 A * 7/1966 Pipe ..... 160/197
3,318,047 A * 5/1967 Carson ..... 49/149
3,348,603 A * 10/1967 Ford ..... 160/197
3,491,483 A * 1/1970 Miller et al. ..... 49/141
3,642,051 A * 2/1972 Goldner ..... 160/197
3,711,995 A * 1/1973 Anderson ..... 49/504
3,785,090 A * 1/1974 MacGillis ..... 49/425
4,229,905 A * 10/1980 Rush ..... 49/143
4,425,739 A * 1/1984 Garbell ..... 49/424
4,437,266 A * 3/1984 Keller ..... 49/493.1
4,619,074 A * 10/1986 Leung et al. ..... 49/143
4,646,471 A * 3/1987 Shaiu ..... 49/231
5,005,315 A * 4/1991 Jackson, Jr. ..... 49/127
5,131,188 A * 7/1992 Hutchison et al. ..... 49/404
5,285,606 A * 2/1994 Hagemeyer ..... 52/204.68
5,542,214 A * 8/1996 Buening ..... 49/380
5,740,641 A * 4/1998 Oxnard ..... 52/234
5,996,281 A * 12/1999 Takano et al. ..... 49/26
6,014,840 A * 1/2000 Ray et al. ..... 49/413
6,058,665 A * 5/2000 Halvorson et al. ..... 52/205
6,082,050 A * 7/2000 Schilling ..... 49/505
(Continued)

*Primary Examiner* — James M Ference
(74) *Attorney, Agent, or Firm* — Keisling & Pieper PLC; Trent C. Keisling

(57) ABSTRACT

The improved sliding glass door or window includes several glass panels that are mounted free-floating in a split frame with an upper and lower section that permits the glass panels to form at least a portion of an external wall of a skybox or the like. The frame and the glass panels that form the portion of the external wall preserves the weatherproofing of the room while also maintaining the safety and security of the room. The glass panels include spaced apart stationary end panels and at least one movable intermediate panel and possibly more intermediate panels as desirable. The end panels each abut against respective room walls with a flexible strip to seal the sliding glass door or window to the walls. The movable intermediate panels may be moved interiorly toward a fixed wall to provide access to the exterior of the room. The intermediate panels seal against the stationary panels to seal the sliding glass door or window thereto.

20 Claims, 5 Drawing Sheets

(56) References Cited

U.S. PATENT DOCUMENTS

| | | | | |
|---|---|---|---|---|
| 6,209,612 | B1 * | 4/2001 | Schack et al. | 160/197 |
| 6,393,778 | B1 * | 5/2002 | Ting | 52/204.5 |
| 6,438,912 | B1 * | 8/2002 | Avent | 52/207 |
| 6,470,952 | B1 * | 10/2002 | Cline et al. | 160/188 |
| 6,526,695 | B1 * | 3/2003 | Nguyen | 49/141 |
| 6,532,699 | B1 * | 3/2003 | Franklin et al. | 52/29 |
| 6,591,552 | B1 * | 7/2003 | Rasmussen | 49/413 |
| 6,718,696 | B2 * | 4/2004 | Silberman et al. | 52/6 |
| 6,871,448 | B1 * | 3/2005 | Kline | 49/319 |
| 6,892,783 | B1 * | 5/2005 | Comeau et al. | 160/126 |
| 6,901,705 | B1 * | 6/2005 | Park | 49/410 |
| 6,955,009 | B2 * | 10/2005 | Rasmussen | 49/413 |
| 7,003,916 | B2 * | 2/2006 | Nestell et al. | 49/413 |
| 7,042,492 | B2 * | 5/2006 | Spinelli | 348/143 |
| 7,117,637 | B2 * | 10/2006 | Delgado et al. | 49/141 |
| 7,150,126 | B2 * | 12/2006 | Rivera | 49/62 |
| 7,155,863 | B2 * | 1/2007 | Daniel et al. | 49/413 |
| 7,395,631 | B2 * | 7/2008 | Lahnala | 49/213 |
| 7,437,852 | B2 * | 10/2008 | Dufour et al. | 49/213 |
| 7,464,501 | B2 * | 12/2008 | Arimoto et al. | 49/413 |
| 7,520,093 | B2 * | 4/2009 | Guhl | 52/204.1 |
| 2002/0148163 | A1 * | 10/2002 | Warner et al. | 49/209 |
| 2004/0025455 | A1 * | 2/2004 | Nubel et al. | 52/204.51 |
| 2004/0049984 | A1 * | 3/2004 | Pfaff | 49/116 |
| 2006/0150512 | A1 * | 7/2006 | Heithe et al. | 49/141 |

* cited by examiner

APPARATUS AND METHOD FOR INSTALLING GLASS

CROSS-REFERENCE TO RELATED APPLICATIONS

This application hereby claims priority to and is a continuation of U.S. patent application Ser. No. 60/817,271, filed Jun. 28, 2006, and U.S. patent application Ser. No. 11/824,584, filed Jun. 28, 2007 now abandoned, both of which are hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates generally to sliding doors and windows. More specifically, the present invention relates to multiple section sliding doors and windows for installations in which it is desirable that the doors or windows be essentially frameless while also forming substantially weathertight exterior seals when closed to preserve the interior of a room. Known art may be found in U.S. Classes 49 and 52, subclasses 505 and 6 and various other classes and subclasses.

2. Description of the Known Art

Sliding doors and windows are well known. The doors or windows usually have a peripheral frame that is suspended from rollers attached to the top rail of the door or window which ride on a track mounted to the top jamb of the door or window opening. The bottom rail of the door or window is usually supported and guided by spring-loaded rollers which ride within a track in the bottom sill of the window opening. The height of the doors or windows closely approximates the height of the opening so as to minimize the gap between the bottom rail of the door or window and the sill.

The known art includes glass doors such as conventional exterior glass patio doors such as those used in residential application as well as conventional interior glass sliding doors such as those used in retail malls and the like. The former are relatively simple installations because they do not encounter shifting loads and weights that their frames must accommodate and they employ peripheral frames around the glass panels while the latter do not employ peripheral frames but fail to form weatherproof seals.

In some settings, doors or windows are installed in applications where the frame of the door or window undesirably interferes with the view from inside an enclosed room. A prime example would be sliding doors or windows in a luxury suite or "sky box" at a stadium, where the spectators are focused on outdoor activity. Such applications are problematic with regard to the structural frame usually securing the door or window and the sill. For example, it is often desirable to leave space in the internal frame of the door or window or otherwise accommodate the live load of stadium seating, as is discussed more thoroughly in U.S. Pat. No. 6,082,050, the teachings of which are incorporated herein. This invention however employs a metal frame with vertical and horizontal members the surround individual glazing panels.

U.S. Pat. No. 6,082,050 discloses a top-hung sliding door or window system for mounting within an opening in a wall includes upper and lower longitudinal tracks mounted to the upper and lower edges of the opening. A top rail is mounted to the upper edge of the glazing panel and is suspended from the upper longitudinal track for longitudinal movement. Vertical rails are mounted to the vertical edges of the glazing panel. A bottom rail is supported on the lower longitudinal track for longitudinal movement. A bottom rail insert is mounted to the lower edge of the glazing panel and engages the bottom rail for vertical movement relative thereto. Vertical rail inserts affixed to the ends of the bottom rail and projecting upward therefrom are movably attached to the vertical rails. When the upper edge of the opening is displaced downward, the first and second vertical rails move downward relative to the first and second vertical rail inserts, and the bottom rail insert moves downward on the bottom rail.

Other advances are seen in other art. For example, U.S. Pat. No. 6,718,696 discloses a convertible stadium includes an exhibition area, a seating area and an outer sidewall in which is defined in large opening, preferably located so as to provide favorable outdoor views to the occupants of the stadium. A movable wall member is advantageously position so as to be able to open or close the large opening. When the movable wall member is in a first, retracted position spectators will be provided with a view of the outdoors and a great deal of outdoor air and sunlight. When outdoor conditions are unfavorable for an intended event within the stadium, however, the movable wall member may be repositioned in order to partially or fully close the opening. Such unfavorable conditions may include undesirable sun position, an undesirable amount of wind or humidity; or unfavorable temperatures. The movable wall member may be deployed in combination with a retractable roof in an otherwise indoor stadium, resulting in a convertible stadium that may be converted to have a true outdoor feel during favorable weather conditions U.S. Pat. No. 5,740,641 discloses a self storage warehouse facility (10) has a plurality of separate insulated self storage rooms (12) each having an exterior foldable door (14) mounted for movement between open and closed positions to permit access to the insulated storage room (12). The foldable door (14) has a plurality of insulated partitions (50, 52, 54) having rollers (66) mounted in guide rails or tracks (42) for movement. In closed position, the lower partition (54) has a lower tubular seal (74) which seals against the foundation (11) and an adjacent ledge (74, FIG. 4). The entire outer perimeter of the door (14) is sealed against a rubber strip (40) along the side edges and upper edge of the door (14). A tubular seal (72) seals along the bottom edge of the door (14). A solenoid operated damper (82, FIG. 7) in a cool air duct (80) is moved to a closed position by energizing of the solenoid (87) upon opening of the door (14). The damper (82) is opened upon return of the door (14) to a closed position The known art fails to provide a satisfactory door or window for luxury stadium seating that permits uninterrupted viewing of sporting events while addressing the needs to accommodate potential load shifts and the like. Thus there is a need for a sliding door or window which can accommodate such needs.

There is a further need for a sliding door or window which facilitates uninterrupted event viewing without requiring undesirably obstructive framing but while still preserving the weather proof integrity of the room.

There is a still further need for a sliding door or window which can accommodate live loads without requiring a deep track to conceal the gap between the bottom rail of the door or window and the adjacent threshold or sill. Of course, such a sliding door or window must preserve the structural integrity of the facility while also maintaining an appropriate level of safety and security in the individual room. It is also desirable to provide a method for the proper installation of an improved sliding glass door or window in accordance with the present invention.

SUMMARY OF THE INVENTION

In accordance with one exemplary embodiment of the present invention, an improved apparatus and method for installing glass is provided. The improved sliding glass door or window may be easily installed in new construction or simply retrofitted to existing construction. The improved sliding glass door or window may be quite advantageously employed with luxury skybox seating and the like.

The improved sliding glass door or window does not employ a peripheral frame and thus provides an enhanced viewing opportunity for occupants of luxury skyboxes and the like while preserving the structural integrity of the facility and the safety and security of the individual skybox. The improved sliding glass door or window may be opened during pleasant weather for open viewing or closed during inclement weather in a weatherproof disposition to maintain the habitability of the enclosure. The improved sliding glass door or window also accommodates the live loading that is often associated with skyboxes sandwiched between upper and lower stadium seating.

The improved sliding glass door or window includes several glass panels that are mounted free-floating in a split frame with an upper and lower section that permits the glass panels to form at least a portion of an external wall of a skybox or the like. The frame and the glass panels that form the portion of the external wall preserves the weatherproofing of the room while also maintaining the safety and security of the room.

The glass panels include spaced apart stationary end panels and at least one movable intermediate panel and possibly more intermediate panels as desirable. The end panels each abut against respective room walls with a flexible strip to seal the sliding glass door or window to the walls. The movable intermediate panels may be moved interiorly toward a fixed wall to provide access to the exterior of the room. The intermediate panels seal against the stationary panels to seal the sliding glass door or window thereto. All of the panels seal to the upper and lower frame sections to thereby seal the glass door or window and the room.

The upper frame section includes spaced apart outer and inner mounting tracks that each captivate the uppermost horizontal portion of the glass panels mounted therein. The outer track captivates the end stationary glass panels while the inner track captivates the movable intermediate glass panels. Each of the tracks also include an internal peripheral felt strip that each of the panels sit against and that seals each of the glass panels inside the section to prevent the entry of debris and water therethrough. Space is provided above each glass panel in the upper frame section to accommodate any deflective movement of the section with respect to the glass panels.

The lower frame section includes a rigid sill that includes an upwardly protruding outer guide track, a spaced apart upwardly protruding inner guide track and a spaced apart innermost raised lip. The outer guide track and sill support a rigid style around the lowermost portion of the stationary panels. The inner guide track and sill supports a rolling rigid style around the lowermost horizontal portion of each movable glass panel. The innermost raised lip prevents the entry of debris and water past the sill.

The style on each glass panel substantially captivates the lowermost section of each panel. Each style includes a groove in its bottom that accepts the upwardly protruding guide track on the sill to seat the glass panels on the sill. Each style includes a plurality of internal rollers adjacent each vertical end of each panel. Each roller is adapted to sit atop a guide track to support the panel thereon.

The method for installing the sliding glass door or window is adaptable for new construction and retrofitting to existing installations.

It is an object of the present invention to provide an improved sliding glass door or window that is without vertical frame members.

It is a further object of the present invention to provide an improved sliding glass door or window that enables spectators at sporting events to enjoy a field of vision that is substantially uninterrupted by window framing.

It is a further object of the present invention to provide an improved sliding glass door or window that preserves the structural integrity of a public facility while also maintaining the safety and security of individual rooms in the facility.

It is an object of the present invention to provide an improved sliding glass door or window that enhances spectator satisfaction at sporting events.

It is an object of the present invention to provide an improved sliding glass door or window that preserves the weatherproofing of a facility while providing selected access to the facility exterior.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
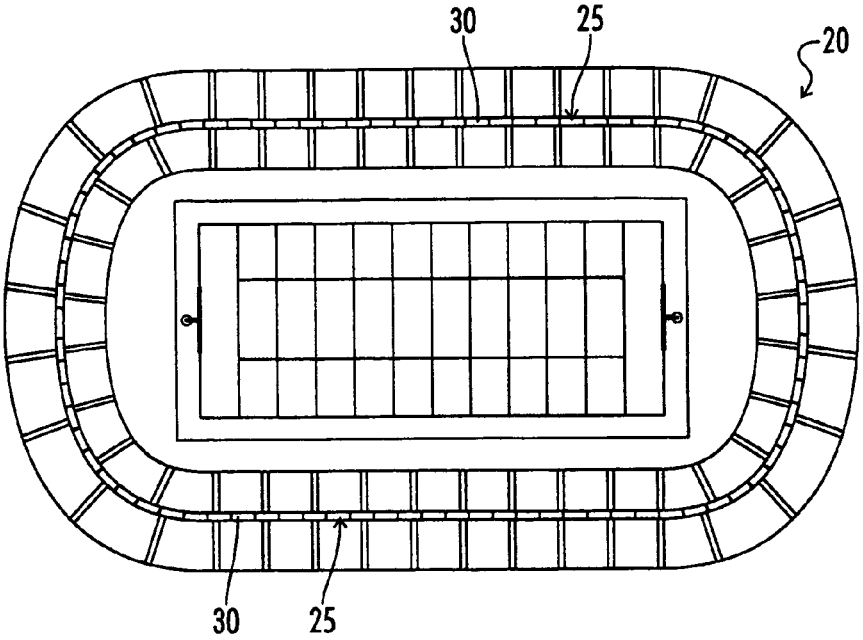
FIG. 1 is an environmental view of the invention showing the improved sliding door or window installed in a series of luxury skyboxes at an entertainment stadium.
Figure 2:
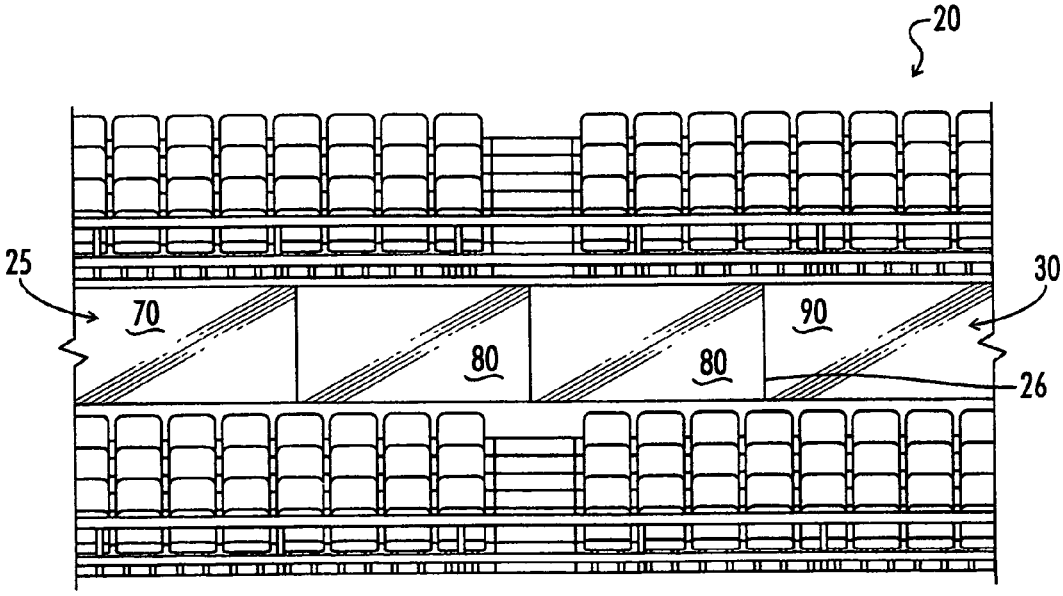
FIG. 2 is a perspective view taken generally from the front of a section of FIG. 1 and showing a skybox with four glass panels.
Figure 3:
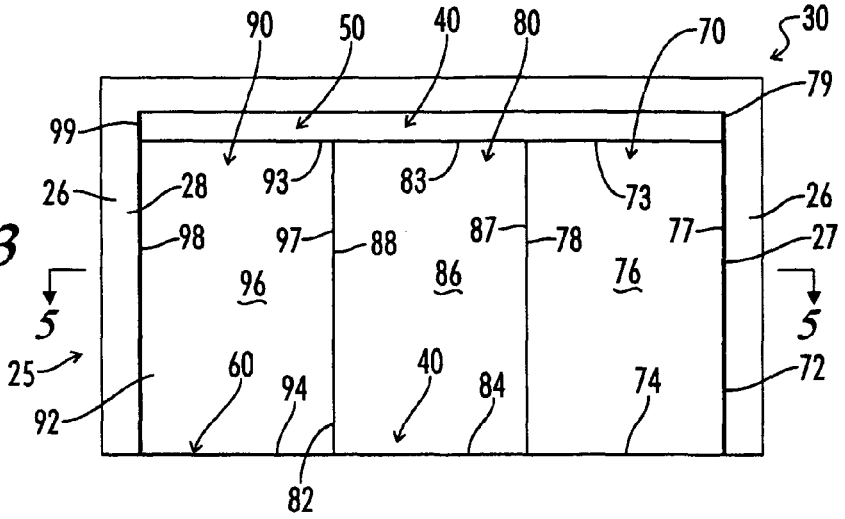
FIG. 3 is a front elevational view of an individual skybox with another exemplary embodiment of the invention installed therein with three glass panels.
Figure 4:
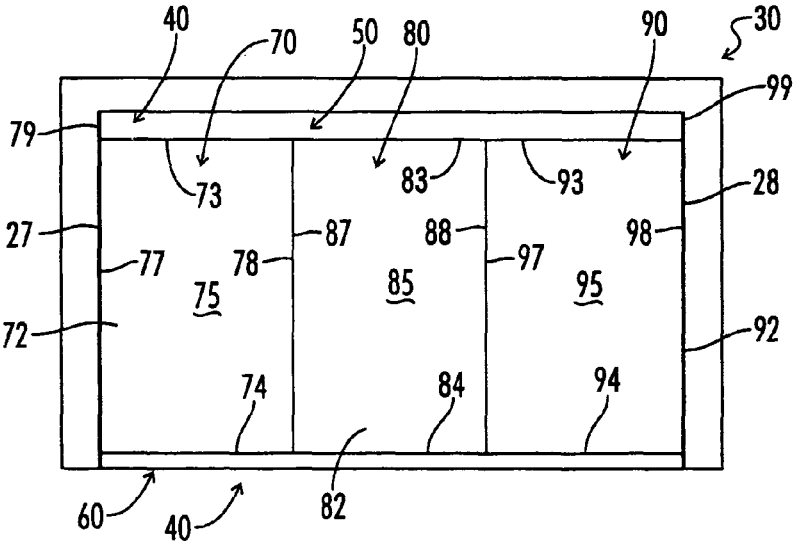
FIG. 4 is a rear elevational view thereof.
Figure 5:
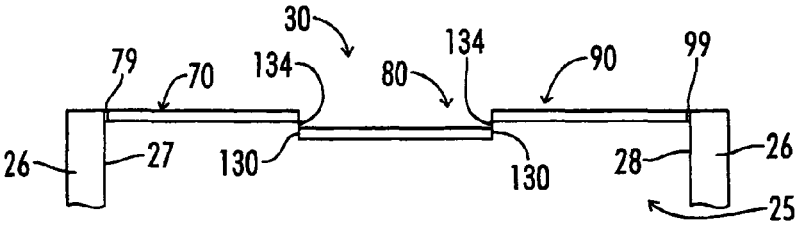
FIG. 5 is a cross-sectional view taken along line 5-5 of FIG. 3 with portions omitted or shown in section for clarity.
Figure 6:
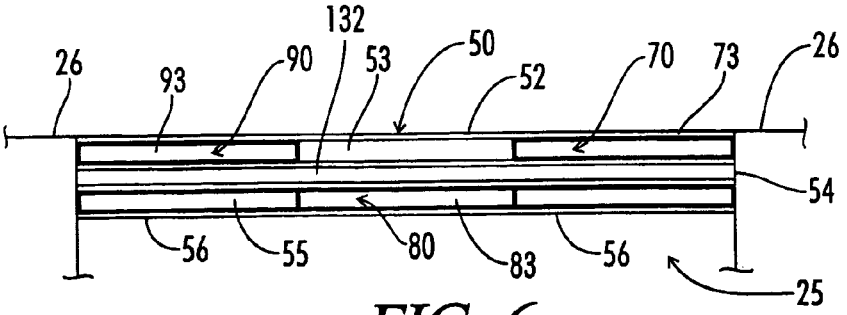
FIG. 6 is a top plan view with portions omitted or shown in section for clarity.
Figure 7:
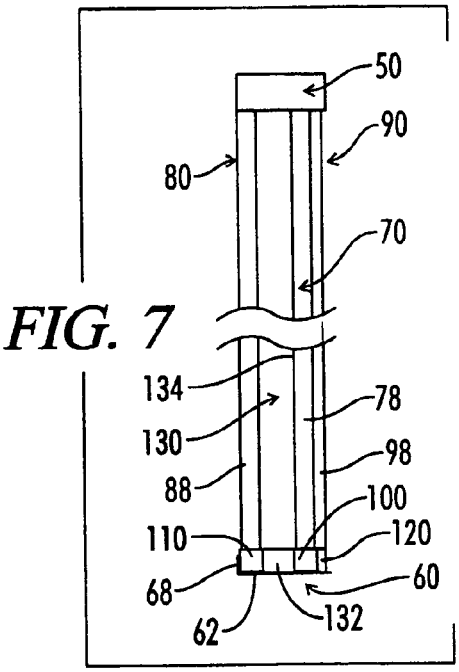
FIG. 7 is a right side elevational view taken generally from the right side of FIG. 4, with the opposite side being a mirror image thereof.
Figure 8:
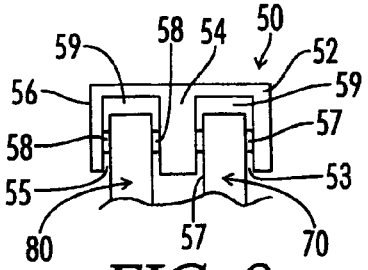
FIG. 8 is an enlarged elevational view of the upper portion of FIG. 7 with the end covering omitted for clarity.
Figure 9:
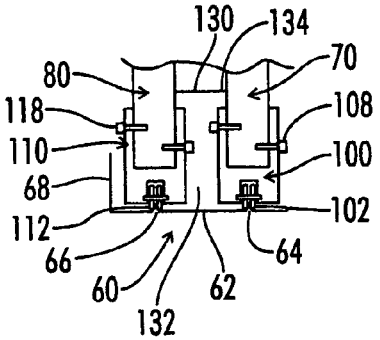
FIG. 9 is an enlarged elevational view of the lower portion of FIG. 7 with the end covering omitted for clarity.
Figure 10:
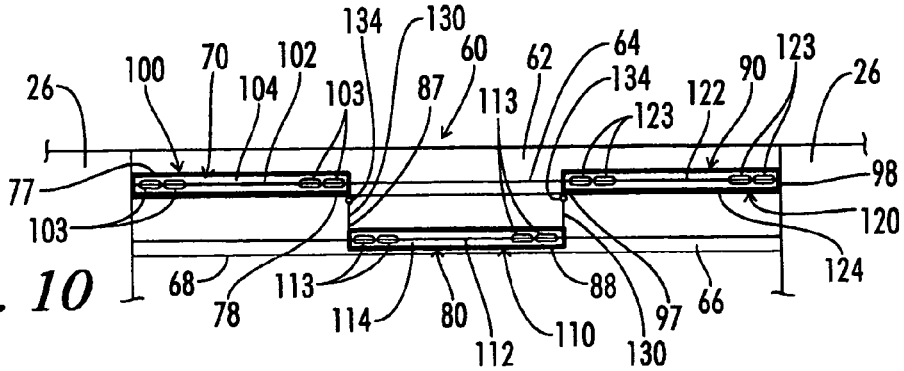
FIG. 10 is a bottom plan view thereof.
Figure 11:
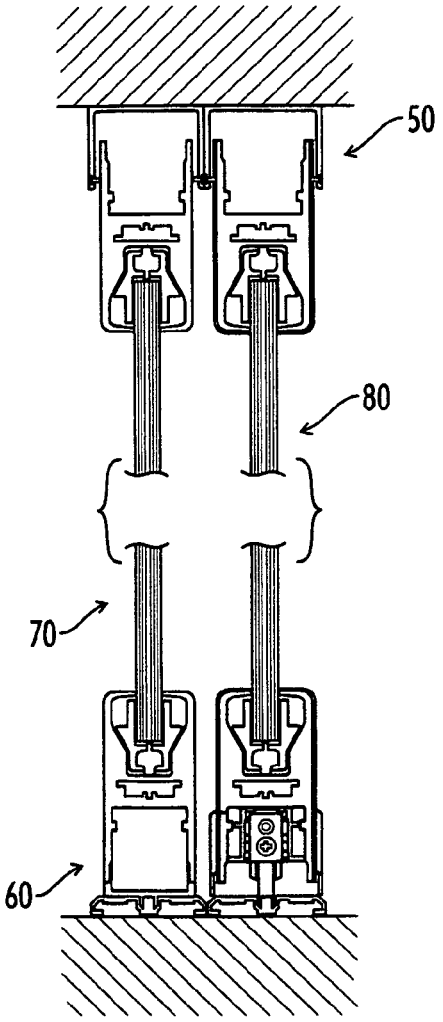
FIG. 11 is a side elevational view with the end covering omitted for clarity showing movable and fixed panels of an alternative embodiment.
Figure 12:
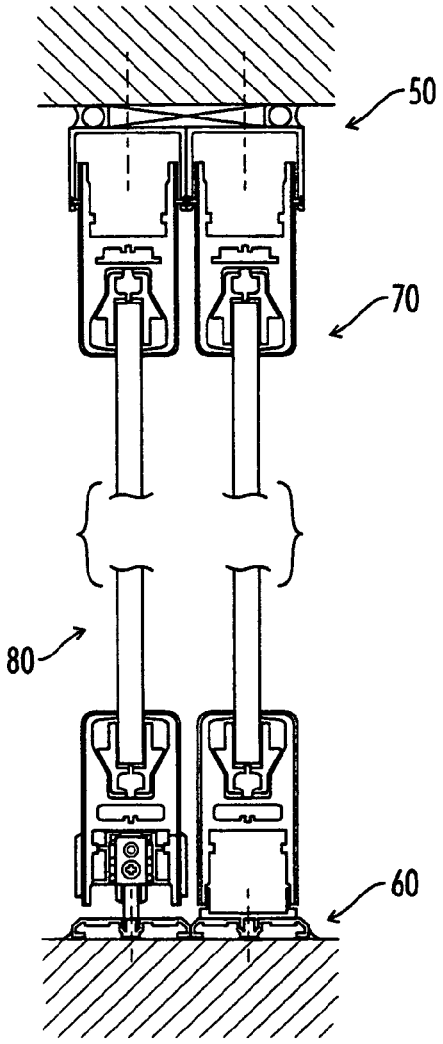
FIG. 12 is a side elevational view similar to FIG. 11 but taken from the opposite end.
Figure 13:
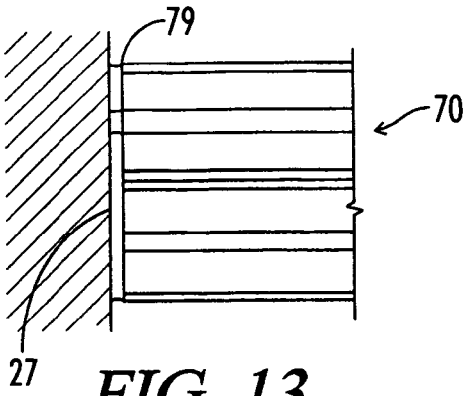
FIG. 13 is a top plan view of another alternative embodiment of a four panel window installation at a wall end.
Figure 14:
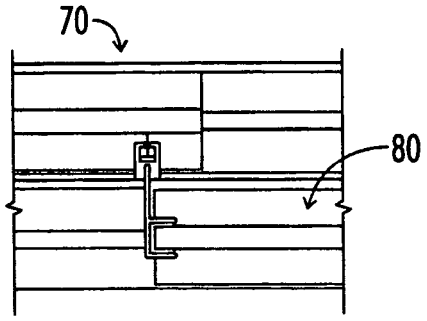
FIG. 14 is a top plan view at the juncture of a fixed and movable panel.
Figure 16:
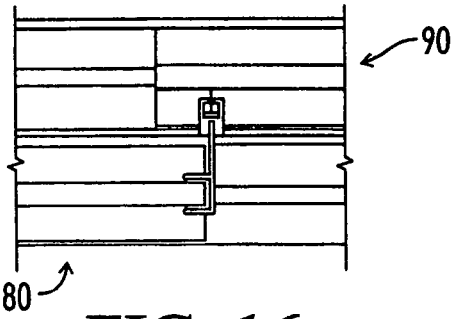
FIG. 16 is a top plan view similar to FIG. 14 but showing another juncture of a moving panel and a fixed panel at the opposite end of the window; and, FIG. 17 is a top plan view another embodiment showing a window installation with two fixed abutting panels.
Figure 15:
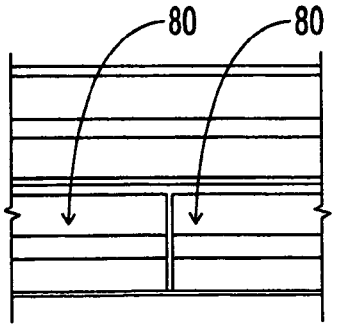
FIG. 15 is a top plan view of abutting moving panels.
Figure 17:
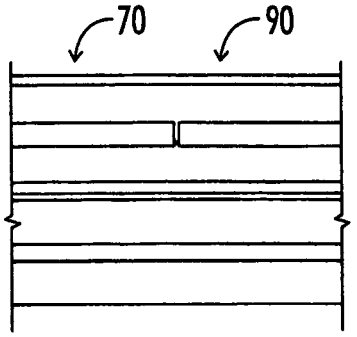

As shown in FIG. 1 of the drawings, one exemplary embodiment of the present invention is generally designated by reference numeral 30. The improved transparent door or window assembly 30 may be easily installed in new construction or simply retrofitted to existing construction. The improved door or window 30 may be quite advantageously employed with luxury skyboxes in most conventional stadiums 20 and the like.

The improved transparent door or window 30 does not employ a peripheral frame and thus provides an enhanced viewing opportunity for occupants of luxury skyboxes and the like while preserving the structural integrity of the facility and the safety and security of the individual skybox 25. The improved sliding door or window 30 may be opened during pleasant weather for open viewing or closed during inclement weather in a weatherproof disposition to maintain the habitability of the enclosure. The improved sliding door or window 30 also accommodates the live loading that is often associated with skyboxes sandwiched between upper and lower stadium seating.

The improved sliding door or window 30 includes several substantially transparent panels 70, 80, 90 that are mounted in a split frame 40 with an upper 50 and lower section 60 that permits the glass panels 70, 80, 90 to form at least a portion of an external wall 26 of the skybox 25. The frame 40 and the transparent panels 70, 80, 90 that form the portion of the external wall 26 preserves the weatherproofing of the room while also maintaining the safety and security of the room.

The upper frame section 50 includes a front half 52 that is closed to the exterior of the skybox 25 and open to the interior of the skybox 25. The front half 52 forms the front of an outer mounting track 53. An intermediate section 54 forms the back half of the outer mounting track 53 and the front half of the inner mounting track 55. The back half 56 forms the back of the inner mounting track 55. The spaced apart outer and inner mounting tracks 53, 55 captivate the uppermost horizontal portion of the panels 70, 80, 90 or tops 73, 83, 93 mounted therein. The upper frame section 50 may be formed from various rigid materials of suitable strength including metals such as steel or aluminum or even wood or the like. The outer track 53 captivates the end stationary glass panels 70, 90 while the inner track 55 captivates the movable intermediate glass panels 80. Each of the tracks 53, 55 also include internal peripheral felt strips 57, 58 that each of the panels 70, 80, 90 sit against and that seals each of the glass panels 70, 80, 90 inside the section 50 to prevent the entry of debris and water therethrough. An expansion slot or space 59 is provided above each glass panel 70, 80, 90 in the upper frame section 50 to accommodate any deflective movement of the section with respect to the glass panels. This space may be between 0.5 inches and 3 inches in depth to provide suitable space for the glass panels to move inside the upper frame section 50. This is necessary to prevent cracking or breaking of the glass panels that could occur if the frame flexed in response to loads such as with people entering and/or leaving the stadium (i.e. the effective load on the structure changing).

The lower frame section 60 includes a rigid sill 62 that includes an upwardly protruding outer guide track 64, a spaced apart upwardly protruding inner guide track 66 and a spaced apart innermost raised lip 68. The outer guide track 64 and sill 62 support a rigid style 100, 110 around the lowermost portion of the stationary panels 70, 90. The inner guide track 66 and sill 62 support a rolling rigid style 120 around the lowermost horizontal portion of each movable glass panel 80. The innermost raised lip 68 prevents the entry of debris and water past the sill 62.

The panels 70, 80, 90 include spaced apart stationary end panels 70, 90 and at least one movable intermediate panel 80 and possibly more intermediate panels 80 as desirable. Each of the panels 70, 80, 90 is similar in construction and composition. While in one known embodiment, panels 70, 80, 90 have been formed from glass approximately ⅜" to ¾" in thickness and up to 100" in height and between 40" and 65" in width, other thicknesses and heights and widths are possible as desirable and are intended to be included within the scope of the present invention. Further, while the panels are made from substantially transparent glass, other suitably transparent and rigid materials may also be utilized, such as plexiglass or the like. Each of the panels 70, 80, 90 further roughly forms a flat parallelepiped shape 72, 82, 92 and thus has a spaced apart top 73, 83, 93 and bottom 74, 84, 94 and spaced apart interior 75, 85, 95 and exterior 76, 86, 96 surfaces as well as spaced apart sides 77, 78, 87, 88, 97, 98.

The end panels 70, 90 each abut against respective room walls 27, 28 along sides 77, 98 with a flexible strip 79, 99 that seals the sliding assembly 30 to the walls 27, 28. The movable intermediate panels 80 may be moved interiorly toward one of the fixed walls 27, 28 to provide access to the exterior of the room. The intermediate panels 80 also seal against the stationary panels 70, 90 to also form an impenetrable barrier at this junction as well. All of the panels 70, 80, 90 also seal against the upper and lower frame sections 50, 60 to thereby seal the door or window and the skybox 25.

The style 100, 110, 120 on each glass panel 70, 80, 90 substantially captivates the lowermost section of each panel proximate the panel bottom 74, 84, 94. Each style 100, 110, 120 includes a groove 102, 112, 122 in its bottom 104, 114, 124 that accepts the upwardly protruding guide track 64, 66, 64 on the sill to seat the glass panels 70, 80, 90 on the sill 62. Each style 100, 110, 120 includes a plurality of internal rollers 103, 113, 123 adjacent each panel vertical end 77, 78, 87, 88, 97, 98. Each roller 103, 113, 123 is adapted to sit atop a guide track 64, 66, 64 to support the panel 70, 80, 90 thereon. Each style 100, 110, 120 includes an inner side 104, 114, 124 and an outer side 106, 116, 126 that essentially wrap around each panel bottom 74, 84, 94 and the lowermost portion of each interior and exterior panel surface 75, 76, 85, 86, 95, 96. The styles 100, 110, 120 employ a plurality of screws 108, 118, 128 that penetrate both the respective style and the panel to secure the style 100, 110, 120 to each panel 70, 80, 90 respectively. While screws have been used, bolts, rivets and other fasteners may be used as well.

The mobile panel 80 includes a flexible wing 130 spanning the gap 132 between the stationary panels 70, 90 and the mobile panel 80 to seal the gap 132. A semi-rigid strip 134 adjacent the end of the wing 130 abuts the stationary panels 70, 90. The flexible wing 130 thus seals the gap during movement of panel 80 to prevent undesirable materials entering between the respective panels 70 and 80 or 80 and 90. Of course, with multiple mobile panels 80, multiple wings 130 are deployed on each end of each mobile panel 80. Flexible strips may be inserted between abutting mobile panels 80 as well to preserve weatherproofing therebetween.

The method for installing the sliding glass door or window is adaptable for new construction and retrofitting to existing installations. Any preexisting framed windows or doors are removed in a conventional manner for retrofitting and the support surfaces prepared accordingly as in new construction.

The sill 62 is installed on the floor of the skybox 25. The exterior front 52 of the frame 50 is installed proximate the ceiling of the skybox 25. The panels 70, 90 are then inserted on the outer guide track 64. Intermediate section 54 is then installed to fix the panels 70, 90 in place. The panels 70, 90 may also be fixed by suitable anchoring to the sill 62 as with screws or the like. The panel 80 is then inserted on the inner guide track 66. The rear section 56 is then installed with screws or the like to slidingly fix panel 80 against panels 70, 90 and between frame members 50, 60. The panel 80 is mobile and may move toward panel 70, 90 to open room 25. An optional weatherstiping panel with an H-shaped cross-section may be placed between panels during extended periods of inactivity to further enhance the weatherproofing of the skybox 25.

Thus, the present invention provides an improved sliding glass door or window that is without vertical frame members to facilitate unobstructed viewing of sporting events and the like. The spectator's field of vision is substantially uninterrupted by window framing, which enhances spectator satisfaction at sporting events.

The present invention also provides an improved sliding glass door or window that preserves the structural integrity of a public facility while also maintaining the safety and security of individual rooms in the facility. The present invention preserves the weatherproofing of a facility while providing selected access to the facility exterior.

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, claims should not be interpreted to have 'means plus function language' unless the word 'means' is specifically used in the claim element.

What is claimed is:

1. An improved sliding glass door or window assembly that facilitates substantially unobstructed spectator viewing from a selectively enclosed room with a floor and a ceiling, said assembly comprising:

a sectioned frame adapted to support a plurality of substantially transparent and rigid panels that permit viewing therethrough while preserving the weatherproofing of the room, said frame having an upper section proximate the room ceiling and adapted to captivate a portion of said panels and a lower section proximate the room floor and adapted to support said panels;

a plurality of substantially transparent and rigid panels adapted to be deployed between said upper section and said lower section, said plurality of panels including spaced apart stationary end panels adapted to be immobilized during deployment and at least one mobile panel adapted to selectively move during deployment, and said panels each further comprise a rigid style proximate said lower frame section, and said at least one mobile panel further comprising a plurality of rotary rollers adapted to engage a guide formed on said lower section; and, a slot formed inside said upper section and above said plurality of panels and adapted to permit said panels to move vertically inside said upper section to accommodate movement of said panels relative to said upper section.

2. The assembly as recited in claim 1 wherein said slot is between one and four inches in depth.

3. The assembly as recited in claim 1 wherein said upper section further comprises a compressible strip proximate the lower edge of said upper section and adapted to form a weatherproof barrier between said upper section and said panels while permitting relative movement therebetween.

4. The assembly as recited in claim 1 wherein said lower section further comprises an innermost raised lip protruding upwardly behind said panels inside the room, said lip adapted to prevent entry of undesirable materials into said room beneath said panels.

5. The assembly as recited in claim 1 wherein said stationary panels each further comprises a side that abuts a rigid side of the room with a flexible seal between said panel sides and the room sides.

6. The assembly as recited in claim 1 wherein said at least one mobile panel further comprises a flexible wing spanning the gap between the stationary panels and said at least one mobile panel to seal the gap.

7. The assembly as recited in claim 6 wherein said wing includes a semi-rigid strip adjacent the end of the wing abutting said stationary panels.

8. The assembly as recited in claim 1 wherein said at least one mobile panel comprises multiple panels, each deployed vertically abutting with a flexible strip therebetween.

9. An improved sliding glass door or window assembly that facilitates substantially unobstructed spectator viewing from a selectively enclosed room with a floor and a ceiling, said assembly comprising:

a sectioned frame adapted to support a plurality of substantially transparent and rigid panels that permit viewing therethrough while preserving the weatherproofing of the room, said frame having an upper section proximate the room ceiling and adapted to captivate a portion of said panels and a lower sill proximate the room floor and adapted to support said panels;

a plurality of substantially transparent and rigid panels adapted to be deployed between said upper section and said lower section, said plurality of panels including spaced apart stationary end panels adapted to be immobilized during deployment and at least one mobile panel adapted to selectively move during deployment, said at least one mobile panel further comprising a rigid style having a plurality of rotary rollers adapted to engage a guide formed on said sill, said rotary rollers secured proximate each panel end;

an innermost raised lip protruding upwardly from said sill and behind said panels inside the room, said lip adapted to prevent entry of undesirable materials into said room beneath said panels; and, a slot formed inside said upper section and above said plurality of panels and adapted to permit said panels to move inside said upper section to accommodate movement of said upper section relative to said panels.

10. The assembly as recited in claim 9 wherein said slot is between one and four inches in depth.

11. The assembly as recited in claim 10 wherein said upper section further comprises a compressible strip proximate the lower edge of said upper section and adapted to form a weatherproof barrier between said upper section and said panels while permitting relative movement therebetween.

12. The assembly as recited in claim 10 wherein said stationary panels each further comprises a side that abuts a rigid side of the room with a flexible seal between said panel sides and the room sides.

13. The assembly as recited in claim 10 wherein said at least one mobile panel further comprises a flexible wing spanning the gap between the stationary panels and said at least one mobile panel to seal the gap.

14. The assembly as recited in claim 13 wherein said wing includes a semi-rigid strip adjacent the end of the wing abutting said stationary panels.

15. The assembly as recited in claim 9 wherein said at least one mobile panel comprises multiple panels, each deployed vertically abutting with a flexible strip therebetween.

16. An improved sliding glass door or window assembly that facilitates substantially unobstructed spectator viewing from a selectively enclosed room with a floor and a ceiling, said assembly comprising:

a sectioned frame adapted to support a plurality of substantially transparent and rigid panels that permit viewing therethrough while preserving the weatherproofing of the room, said frame having an upper section proximate the room ceiling and adapted to captivate a portion of said panels and a lower sill proximate the room floor and adapted to support said panels;

a plurality of substantially transparent and rigid panels adapted to be deployed between said upper section and said lower sill, said plurality of panels including spaced apart stationary end panels adapted to be immobilized during deployment and at least one mobile panel adapted to selectively move during deployment, said at least one mobile panel further comprising a rigid style having a plurality of rotary rollers adapted to engage a guide formed on said sill, said rotary rollers secured proximate each panel end;

a slot formed inside said upper section and above said plurality of panels and adapted to permit said panels to move inside said upper section to accommodate movement of said panels relative to said upper section;

a flexible wing spanning the gap between the stationary panels and said at least one mobile panel to seal the gap; and, a semi-rigid strip adjacent the end of the wing abutting said stationary panels.

17. The assembly as recited in claim 16 wherein said upper section further comprises a compressible strip proximate the lower edge of said upper section and adapted to form a weatherproof barrier between said upper section and said panels while permitting relative movement therebetween.

18. The assembly as recited in claim 16 wherein said sill further comprises an innermost raised lip protruding upwardly behind said panels inside the room, said lip adapted to prevent entry of undesirable materials into said room beneath said panels.

19. The assembly as recited in claim 16 wherein said stationary panels each further comprises a side that abuts a rigid side of the room with a flexible seal between said panel sides and the room sides.

20. The assembly as recited in claim 16 wherein said at least one mobile panel further comprises a flexible wing spanning the gap between the stationary panels and said at least one mobile panel to seal the gap.

* * * * *